US011486281B2

(12) United States Patent
Rislå et al.

(10) Patent No.: US 11,486,281 B2
(45) Date of Patent: Nov. 1, 2022

(54) FLUID SEPARATOR FOR A DISPLACEMENT MACHINE AND A METHOD FOR SEPARATING LUBRICANT AND WORKING FLUID IN A DISPLACEMENT MACHINE

(71) Applicant: HEATEN AS, Kristiansand S (NO)

(72) Inventors: Harald Nes Rislå, Lillesand (NO); Christian Schlüter, Iserlohn (DE); Christoph Altvater, Castrop-Rauxel (DE)

(73) Assignee: HEATEN AS, Kristiansand S (NO)

( * ) Notice: Subject to any disclaimer, the term of this patent is extended or adjusted under 35 U.S.C. 154(b) by 249 days.

(21) Appl. No.: 16/344,893

(22) PCT Filed: Oct. 26, 2017

(86) PCT No.: PCT/NO2017/050272
§ 371 (c)(1),
(2) Date: Apr. 25, 2019

(87) PCT Pub. No.: WO2018/080316
PCT Pub. Date: May 3, 2018

(65) Prior Publication Data

US 2019/0257230 A1 Aug. 22, 2019

(30) Foreign Application Priority Data

Oct. 26, 2016 (NO) ..... 20161697

(51) Int. Cl.
*F01M 13/04* (2006.01)

(52) U.S. Cl.
CPC . *F01M 13/0416* (2013.01); *F01M 2013/0438* (2013.01); *F01M 2013/0494* (2013.01)

(58) Field of Classification Search
CPC .... F01M 13/00; F01M 13/04; F01M 13/0416; F01M 2013/0438; F01M 2013/0494;
(Continued)

(56) References Cited

U.S. PATENT DOCUMENTS 3,241,537 A 3/1966 Jones
4,136,650 A 1/1979 Manookian, Jr.
(Continued)

FOREIGN PATENT DOCUMENTS

EP 2090760 8/2009
FR 2921101 3/2009
(Continued)

OTHER PUBLICATIONS

Norwegian Search Report, Norwegian Patent Application No. 20161697, dated May 19, 2017.
(Continued)

*Primary Examiner* — Grant Moubry
(74) *Attorney, Agent, or Firm* — Andrus Intellectual Property Law, LLP

(57) ABSTRACT

A displacement machine is for acting on a working fluid and is provided with a lubricant and working fluid separator. The fluid separator has a separator volume constrained by a shielding member, a first fluid channel providing fluid communication between a first and second inner volumes and the separator volume, a second fluid channel providing fluid communication between the separator volume and a working fluid return volume. The fluid separator, the first fluid channel and the second fluid channel are fully contained within a full volume of the displacement machine. A method is for separating lubricant and working fluid in a displacement machine.

13 Claims, 5 Drawing Sheets

(58) Field of Classification Search
CPC . F02G 5/02; F02D 2250/08; F02M 35/10222; F02M 35/10209
See application file for complete search history.

(56) References Cited

U.S. PATENT DOCUMENTS

| | | | | |
|---|---|---|---|---|
| 4,502,424 | A | 3/1985 | Katoh et al. | |
| 4,607,604 | A | 8/1986 | Kanoh et al. | |
| 7,096,847 | B1 | 8/2006 | Nation et al. | |
| 8,342,160 | B2 * | 1/2013 | Heckel | F02M 25/06 123/572 |
| 8,505,521 | B2 * | 8/2013 | Matsushima | F01M 13/04 123/572 |
| 2002/0088212 | A1 | 7/2002 | Ernst et al. | |
| 2003/0024512 | A1 * | 2/2003 | Kitano | F01M 13/022 123/572 |
| 2003/0110743 | A1 * | 6/2003 | Stegmaier | F01M 13/0416 55/337 |
| 2009/0193972 | A1 * | 8/2009 | Schwandt | C09B 69/00 95/247 |
| 2010/0024762 | A1 | 2/2010 | Koyamaishi et al. | |
| 2010/0101425 | A1 * | 4/2010 | Herman | B01D 45/08 96/400 |
| 2011/0016957 | A1 | 1/2011 | Haladyna et al. | |
| 2016/0047283 | A1 | 2/2016 | Newman et al. | |

FOREIGN PATENT DOCUMENTS

| | | |
|---|---|---|
| GB | 1029818 | 5/1966 |
| GB | 2118861 | 11/1983 |
| WO | 2012/019682 | 2/2012 |

OTHER PUBLICATIONS

International Search Report, PCT/NO2017/050272, dated Apr. 18, 2018.
Written Opinion, PCT/NO2017/050272, dated Apr. 18, 2018.

* cited by examiner

FLUID SEPARATOR FOR A DISPLACEMENT MACHINE AND A METHOD FOR SEPARATING LUBRICANT AND WORKING FLUID IN A DISPLACEMENT MACHINE

CROSS-REFERENCE TO RELATED APPLICATIONS

This application is the U.S. national stage application of International Application PCT/NO2017/050272, filed Oct. 26, 2017, which international application was published on May 3, 2018, as International Publication WO 2018/080316 in the English language. The International Application claims priority of Norwegian Patent Application No. 20161697, filed Oct. 26, 2016. The international application and Norwegian application are both incorporated herein by reference, in entirety.

FIELD

A displacement machine is disclosed, said displacement machine being arranged for acting on a working fluid and being provided with a lubricant and working fluid separator, said displacement machine further comprising a displacer housing, a displacer arrangement displaceable within the displacer housing, a working chamber upon which the displacer arrangement acts to change its volume, at least one inner volume arranged for containing a lubricant and a working fluid, working fluid ports providing fluid communication between at least one volume external to the displacement machine and the working chamber, and a leakage path formed between the displacer arrangement and the displacer housing.

A method for separating lubricant and working fluid in a displacement machine acting on a working fluid is also disclosed.

BACKGROUND

Organic Rankine cycle (ORC) systems and heat pumps are of increasing importance for utilizing low temperature heat, and especially waste heat, to increase the energy efficiency of several applications and processes. Further, the utilization of such devices helps greatly in reducing carbon emissions, since they reduce or in some cases even eliminate the need for fossil fuels. ORCs are typically used to convert heat into electricity, even when the heat is at very low temperatures, and at much lower temperatures than most other heat engine cycles are practically capable of. ORCs can in some cases even utilize heat at temperatures below 100° C. to produce power. Heat pumps on the other hand are used to raise the temperature of existing low grade heat sources to temperature levels that make them usable again, for example in food production or in chemical manufacturing processes.

The ORC is in principle similar to the steam engine process, or the so-called Rankine cycle, (which always uses water as working fluid), in that it utilizes the phase change from liquid to vapour and vice versa (boiling and condensation respectively) of a given working fluid. The main difference is that ORCs use working fluids other than water, and most commonly, these alternative working fluids are of an organic nature, such as hydrocarbons or fluorinated organic fluids such as a hydrofluorocarbons (HFCs). ORCs have the advantage that they can achieve relatively high efficiencies and high exergy efficiencies at the same time. This is due to several factors such as the relatively high intrinsic efficiency of the Rankine cycle, as well as the potential for achieving a good temperature gradient match in the heat exchange processes, with a relatively low temperature differential between an inflowing heat transfer fluid and the working fluid throughout the heat exchange processes. This helps to minimize exergy destruction.

The vapour compression (VC) process, which is used in many heat pump technologies, shares many characteristics with the ORC. They can typically operate with the same working fluids, and in principle, the ORC process can roughly be seen as an VC process in reverse. While the VC process uses vapour compression to lift the temperature of a fluid, the ORC uses near-isentropic vapour expansion with resulting temperature and pressure decrease in order to extract work from the fluid, which has first been heated and evaporated in a boiler. In order to perform these processes, a compressor or an expander are used respectively.

The expander is one of the key components in any ORC, just as the compressor is a key component in a VC heat pump system. As the ORC involves a high pressure section based on a boiler/evaporator circuit and a low pressure section based on a condenser circuit, wherein the working fluid is alternately boiled and condensed to high and low pressure respectively, the expander admits and expands the working fluid coming from the high pressure section through an inlet port, and exhausts it into the low pressure section through an exhaust port. The control of fluid admission and exhaust is handled through synchronized inlet and outlet valves, often referred to as admission and exhaust valves. The expansion process converts some of the thermal energy that has been transferred to the working fluid in the evaporator into mechanical work, which in turn is converted into electricity by a generator.

There are several expander types available for use in an ORC. Traditionally, turbines and piston expanders have been used for the most, but there are also several examples of other relevant expander types such as screw expanders, scroll expanders, vane expanders, Wankel expanders and more, and they all have different advantages and disadvantages. The same applies to the reversed process performed by compressors in VC systems, as there are several equivalent compressor types available.

For many ORC applications, and especially small-scale applications in terms of power levels, there is a need to maintain a high level of flexibility as well as a high efficiency level over a broad power output or load range, since small scale applications often have a tendency towards larger variations in heat availability as well as power demand by for example an energy consumer. In other words, small scale ORCs usually must be capable of demonstrating a higher level of operational flexibility than for example a large scale utility power plant, which commonly serves to provide a slowly varying baseload to an energy consumer network. Because of this, the expander type should preferably be selected based on its flexibility.

Piston engines have proven over many years to be highly flexible in small-scale applications, for example for passenger vehicles or smaller power plants in the form of generator sets. The same flexibility is also achievable for ORCs that use piston expanders, and therefore the piston expander is one preferred technology for such use. For VC heat pumps, the same arguments can be used in favour of a piston compressor. In the following, a piston machine, piston expander or piston compressor refers to the same type of general equipment, although the operating cycles and hence the working fluid processes may be reversed.

A conventional piston machine, whether it functions as an expander or a compressor, will typically need lubrication in critical areas to ensure minimal friction and wear, and therefore achieve good performance and long durability. At the same time, most piston machines have a certain leakage between sections containing lubricant and sections containing working fluid. For piston machines serving as combustion engines, it is possible for air or exhaust gases that are present in the cylinder (combustion chamber) to leak past the piston seals—so-called blow-by—and into other internal volumes of the engine. Piston seals are typically not perfect, and usually some leakage must be expected. When this happens, the lubricant/oil that is contained within the engine's internal volume(s) will be contaminated over time. Vice versa, a small quantity of oil will typically leak past the piston in the opposite direction, meaning from internal volume(s) such as from an oil sump, and end up in the combustion chamber/cylinder, where some of it will be affected by the combustion process, and in general, it will be exhausted during an exhaust stroke. This is generally not a problem in modern combustion engines, since there are measures in place to minimize the leakages themselves and their effect on the lubricant. Examples of such measures are to provide good sealing solutions (for example well designed piston rings and cylinder surfaces) that minimize leakage, and replacing the lubricant after a certain number of operating hours.

In the following, the terms lubricant and oil will be used interchangeably.

For many combustion engines, it is common to have a breather outlet coming from for example the cylinder head or another appropriate place. The purpose of the breather is to continuously remove excess air and combustion gases that enter into the engine housing (the internal volume(s)) due to the described leakage. The breather outlet is often connected to a breather line, which leads the gases away from the engine housing, and thereby evacuates them to an appropriate return location, for example to an inlet manifold.

U.S. Pat. No. 4,607,604 discloses a solution for fluid separation in an internal combustion engine, wherein the oil separator is implemented as an embedded device within an engine housing. However, as is common for combustion engines, the return of fluids other than lubricants (e.g. the air and combustion gases) is handled by a breather connection via a breather line (for example a hose) that is routed externally with respect to the engine housing. This means that if there is a leakage in the breather line, these gases may instead be evacuated to the environment. For a combustion engine, this is not necessarily a big problem.

The issues of fluid blow-by and leakage must also be addressed and handled for a piston expander in an ORC, or for a piston compressor in a VC heat pump for that matter. For such applications, the issue of leakage is further different from that of combustion engines, since these processes usually involve condensable working fluids, or in other words fluids that alter between the gaseous and liquid phases. Because of this, working fluid may often mix with the lubricant to ultimately form a thinner lubricant, or in other words, the viscosity of the lubricant will decrease as more and more working fluid is mixed into it, and thus the lubrication of the piston machine would be impaired. At the same time, lubricant may escape from the piston machine by leaking past the piston and end up in a condenser or an evaporator, which are typically connected downstream of the exhaust path or upstream of the suction path of an expander or a compressor respectively. In this case, the amount of lubricant available to the piston machine will decrease, hence lubrication is again impaired.

In order to avoid these effects, a proper fluid separation technique should be implemented, which serves to minimize the amount of working fluid being dissolved or mixed into the lubricant, as well as to prevent lubricant from escaping the piston machine to a large extent. Proper oil separators and other devices for such use are available, but very often these are devices that are designed to be installed externally from the piston machine, or at least they have fluid paths/connections that are external to them, with fluid connections in the form of pipes, hoses and fittings, and therefore the complexity is increased, as well as the number of potential leakage points at the event of a component failure for example. This is also the case for the invention shown in U.S. Pat. No. 4,607,604, wherein a blow-by gas is returned to for example an inlet manifold via an external pipe or hose connection, via an outlet port denoted as 25 in the figure. Further, U.S. Pat. No. 7,096,847B1 shows a similar solution.

SUMMARY

The invention has for its object to remedy or to reduce at least one of the drawbacks of the prior art, or at least provide a useful alternative to prior art.

The object is achieved through features, which are specified in the description below and in the claims that follow.

An external routing of blow-by and leakage fluids is not optimal for an ORC or a VC system, since any fault in a breather line causing leakage would result in working fluid being spilled into the environment. For environmental reasons as well as for the need to maintain the fluids in such systems, this is not acceptable.

This invention seeks to improve on or at least provide an alternative to common techniques for fluid separation in a system utilizing a displacement machine, such as a piston expander or a piston compressor. It further seeks to provide good measures for fluid separation in displacement machines used for ORCs or VC heat pump systems.

The invention involves the use of a fluid separator (for example a lubricant/working fluid separator), which is integrated into an inner volume of a displacement machine. For the description, the term piston machine, piston expander or piston compressor may be used interchangeably to describe a displacement machine. The use of any of these terms shall not be seen as limiting to the type of device for which the invention may be applied. It is merely an aid for describing the invention in a concrete manner. The invention may in principle apply to all types of displacement devices, including expanders and compressors based on any of the available displacement devices, be they a piston, screw, scroll, vane, Wankel machine or any other relevant fluid displacement device.

For the further description of the invention, the "inner volume" of the displacement machine is defined as any volume within the displacement machine not containing solid material, with the exception of the working chamber, i.e. the cylinder volume, which is seen as a special volume. Further, a full volume is defined for the displacement machine. The full volume is defined as the entire volume that the displacement machine occupies, including internal volumes, the combustion chamber and all solid materials. The full volume of the expander is further defined by outer boundaries comprising the outer surfaces of the displacement machine's housing components (e.g. a crankcase, cylinder head, valve cover, oil sump etc.) and other natural interfaces such as the openings of an inlet port and an exhaust port.

The invention provides a solution wherein the entire fluid separator, including fluid distribution channels such as a working fluid return channel and a lubricant return channel, are fully integrated within the full volume of the displacement machine. This way, the risk of fluid leakage to the environment can be eliminated, as there are no external fluid connections required.

The fluid separator has at least two channels for communicating a fluid or a fluid mixture. A first fluid channel (a separator inlet channel) connects the fluid separator to an inner volume of the displacement device containing working fluid and lubricant to be separated. The working fluid is mainly in its gaseous phase, and the lubricant is mainly in its liquid phase. A second channel (a working fluid return channel) connects the fluid separator to a working fluid return volume; and optionally, a third channel (a lubricant return channel) connects the fluid separator to a lubricant return volume. The working fluid return volume is either an exhaust port or a suction port of an expander or a compressor respectively. This way, there is no need for external piping or hoses coming out of the displacement machine in question, and again the risk of fluid leakages to the environment due to a fault in the fluid separator is thus eliminated.

Any of the aforementioned channels may consist of one or more physical passages, and in a simple embodiment, the lubricant return channel may share the same physical passage(s) as the separator inlet channel. Likewise, the lubricant return section may be the same as the volume containing both working fluid and lubricant to be separated. In an even simpler embodiment the fluid separator may simply consist of a pipe connected to the exhaust or suction port of an expander or compressor respectively at one end, and at the other end it may terminate in a location of the inner engine volume, which resides in a section where there is little presence of lubricant, and mainly the presence of working fluid in its gaseous phase. External connections to the fluid separator may also then be omitted entirely, and at the same time, the complexity of the fluid separator is minimized.

A reed valve may be inserted in-line with the working fluid return channel to prevent backflow of working fluid into the displacement machine, if for example pressure pulses in the exhaust port should be higher than the pressure in the inner volume of the displacement machine.

The separator section may be filled with a material, which facilitates coalescence of the lubricant, something that may help the separation process.

The displacement machine may further have an oil sump containing lubricant and a heater submerged in it. The heater is used to boil off working fluid that has been mixed into the oil in here. Under warmer operating conditions, the mixing of working fluid into the lubricant may be limited, but during a cold start-up there may be an increased amount of working fluid mixed into the oil, and boiling off and returning this working fluid prior to start-up will help to improve lubrication overall. For this, the fluid separator plays a critical role in evacuating the excess working fluid that is being boiled off.

There is thus a method in place to ensure that working fluid is boiled off prior to operation of the displacement machine. The method involves heating the oil in the oil sump by means of the heater, prior to starting up the displacement machine. The method may further involve to measure the temperature of the oil in the sump, and to give a ready signal to a control system when the temperature of the oil has reached a certain level.

At the same time as working fluid leaks into the expander's inner volume(s), leakage paths that are available to the working fluid are also available to the oil, so that it may escape into the expander's working chamber/cylinder. As this happens, at least some of the oil may escape the displacement machine, for example through an exhaust port, and via a fluid line into a condenser. As more and more lubricant would escape, lubrication would eventually be impaired.

For a small amount of oil that has escaped the displacement machine and resides in sections external to it, for example in the condenser, the oil can through proper system design be allowed to circulate and return back to the displacement machine via the same leakage paths that are present for the working fluid in the first place. This way, no dedicated external separator is required for the escaped oil, as the oil will be separated intrinsically by the displacement machine itself. This, however, requires for the external system to be designed such that the oil doesn't get trapped in certain regions, and that it may eventually be returned.

Therefore, a small amount of lubricant may be allowed to circulate together with the working fluid at any one time through the various external components of the system, which are external to the expander. Eventually then, it will be returned to the inner volume(s) of the expander. For an ORC system, since there is a pressure difference (the evaporator pressure is under normal circumstances higher than the mean pressures inside the expander) on the evaporator side in favour of letting the fluids flow into the expander, rather than out of the expander, this will ensure a shifted balance fluid-flow-wise, so that the majority of the lubricant will remain within the expander at any time. In other words, the forces that drive the lubricant into the expander are greater than those driving it out, and therefore the equilibrium is shifted in favour of retaining the lubricant within the expander. This is a very simple, yet not necessarily obvious solution, and in order to let this happen, there must also be leakage paths of sufficient dimensions available in order for the lubricant also to return satisfactorily.

The invention is defined by the independent patent claims. The dependent claims define advantageous embodiments of the invention.

In a first aspect, the invention relates more particularly to a displacement machine arranged for acting on a working fluid and being provided with a lubricant and working fluid separator, the displacement machine further comprising a displacer housing, a displacer arrangement displaceable within the displacer housing, a working chamber upon which the displacer arrangement acts to change its volume, at least one inner volume and arranged for containing a lubricant and a working fluid, working fluid ports providing fluid communication between at least one volume external to the displacement machine and the working chamber, and a leakage path formed between the displacer arrangement and the displacer housing, characterized in that the fluid separator comprises a separator volume constrained by a shielding member, a first fluid channel providing fluid communication between the at least one inner volumes and the separator volume, a second fluid channel providing fluid communication between the separator volume and a working fluid return volume, and the fluid separator, the first fluid channel and the second fluid channel are fully contained within a volume defined by an outer boundary wherein the displacement machine is geometrically fully constrained.

A first inner volume may be freely communicating with a second inner volume.

The shielding member may be a baffle shielding a working fluid exit in the fluid separator.

Alternatively, the shielding member may be a housing shielding the working fluid exit in the fluid separator. The housing may contain a coalescence promoting material.

A working fluid exit in the fluid separator may be provided with a valve arrangement arranged to prevent backflow or backpressure from the exhaust port propagating into the separator volume. The fluid separator valve arrangement may be a reed valve arrangement.

A fluid mixture inlet path into the separator volume and a lubricant return path into an appropriate lubricant return volume may be provided in the first fluid channel.

The second fluid channel may extend in a sealed manner into the working fluid return volume through a bore in a cylinder head.

The second fluid channel may be arranged in a cylinder head cover, said fluid channel being defined by a cover and a return pipe extending in a sealed manner from the cover into the working fluid return volume through a bore in a cylinder head.

The working fluid return volume may be inside an exhaust port of an expander or a suction port of a compressor.

In a second aspect, the invention relates more particularly to a method for separating lubricant and working fluid in a displacement machine acting on a working fluid, the displacement machine being geometrically constrained within a full volume defined within an outer boundary and comprising a displacer housing, a displacer arrangement displaceable within the displacer housing, a working chamber upon which the displacer arrangement acts to change its volume, at least one inner volume, a lubricant reservoir containing lubricant and a heater submerged in the lubricant, working fluid ports providing fluid communication between at least one volume external to the displacement machine and the working chamber, and a leakage path formed between the displacer arrangement and the displacer housing, the method comprising the step of providing a fluid separator, the fluid separator comprising a separator volume constrained by a shielding member, a first fluid channel providing fluid communication between the at least one inner volume and the separator volume, and a second fluid channel providing fluid communication between the separator volume and a working fluid return volume, the lubricant being diluted by an amount of working fluid, characterized that the method comprises the further steps:

a) before starting operation of the displacement machine, to transfer heat from the heater to the lubricant, b) boiling off working fluid solved into the lubricant thereby creating working fluid vapour occupying the at least one inner volume of the displacement machine, c) evacuating the working fluid vapour from the displacement machine through channels of the fluid separator to the working fluid return volume, d) measuring the temperature of the lubricant, and e) when the temperature of the lubricant has reached a certain level, which ensures that the lubricant is sufficiently free from working fluid, to start operation of the displacement machine.

The method may comprise the further step of f) separating lubricant and working fluid upstream a second fluid channel.

The method may comprise the further step of f2) the separator volume is constrained by a shielding member upstream a second fluid channel.

The method may comprise the further step of g) evacuating the working fluid vapour from the displacement machine through a return pipe extending in a sealed manner from a cover defining a cavity provided in a cylinder head cover and into an exhaust port provided in a cylinder head.

The method may comprise the further step of providing the fluid separator fully contained within the full volume of the displacement machine.

In a third aspect, the invention relates more particularly to usage of a displacement machine as disclosed above in an organic Rankine cycle application or a vapour compression heat pump application.

BRIEF DESCRIPTION OF THE DRAWINGS

In the following is described examples of preferred embodiments illustrated in the accompanying drawings, wherein.

DETAILED DESCRIPTION OF THE DRAWINGS

Figure 1:
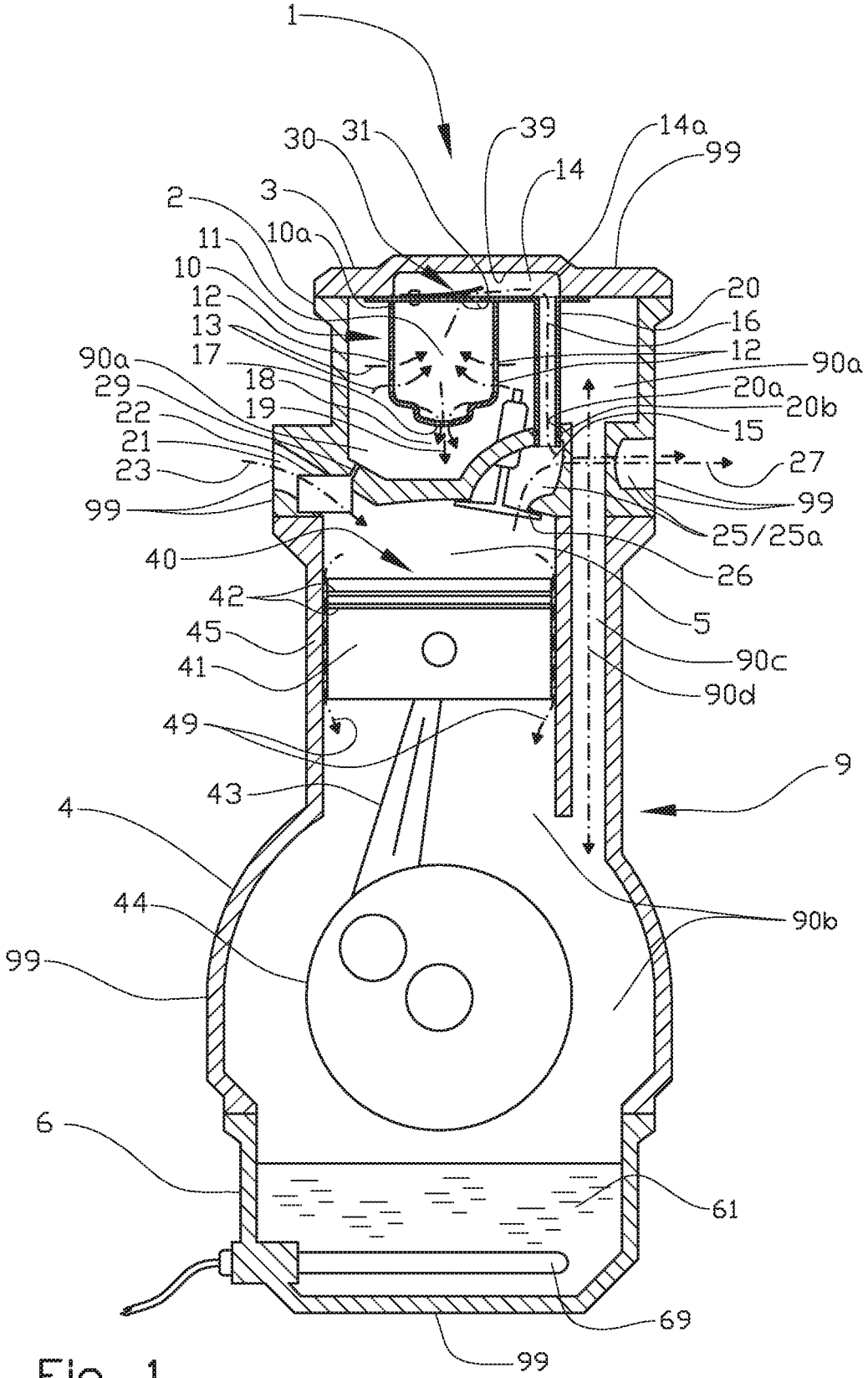
FIG. 1 shows a displacement machine in the form of a piston expander, with a fluid separator integrated within the displacement machine housing and specifically within the cylinder head.
Figure 5:
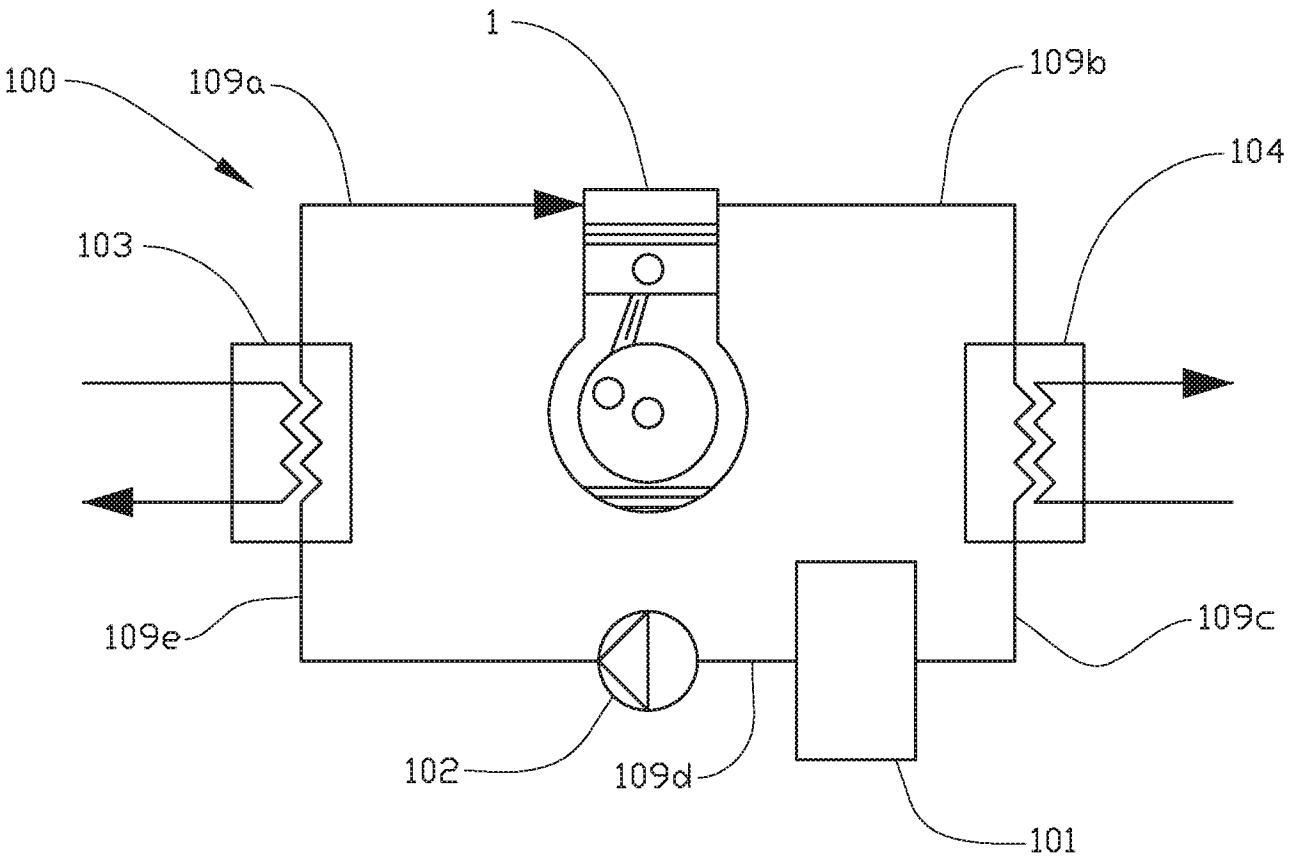
FIG. 5 shows a simplified flow schematic of an organic Rankine cycle, where the expander is in the form of a piston expander.

For the following description, we first turn the attention to FIGS. 1 and 5. A fluid separator 10 is integrated within a displacement machine 1, here shown in the form of an expander of the piston type. The expander 1 is part of an organic Rankine cycle (ORC) system 100 (see FIG. 5). The expander 1 is illustrated on FIG. 1 with a certain level of detail. It should be noted that the invention is not specific to an expander of the piston type for an ORC system, as it applies to any type of system using any type of displacement machine that uses a working fluid and a lubricant.

An evaporator 103 (see FIG. 5) provides working fluid in the form of superheated vapour at high temperature and high pressure to the expander 1 through a first fluid line 109*a*. The expander 1 expands the vapour from high pressure to low pressure, thus generating work, and then exhausts the expanded vapour into a condenser 104 through a second fluid line 109*b*.

There may also exist a recuperator in the ORC system, but this is not shown, as it has no particular importance to the description of the invention.

Downstream of the condenser 104 there is a working fluid reservoir 101 connected to the condenser 104 through a third fluid line 109*c*, the fluid reservoir 101 for example in the form of a closed tank, which serves as a buffer for working fluid primarily in the liquid phase, i.e. after it has been condensed. From the working fluid reservoir 101, a pump 102 draws liquid working fluid through a fourth fluid line 109*d*, and increases the working fluid's pressure, as it is fed into the evaporator 103 through a fifth fluid line 109*e*. The working fluid is then heated, evaporated and superheated in the evaporator, as this completes the full organic Rankine cycle. The fluid lines 109*a*-109*e* are typically in the form of pipes or hoses. The ORC system 100 encompasses further devices (for example electrics and a housing) external to the expander 1, but are not mentioned here for relevance reasons.

Looking again at FIG. 1, the piston expander 1 is assumed to consist of conventional main components such as a crankcase 4, a cylinder head 2, a valve cover 3 and a lubricant reservoir in the form of an oil sump 6. The main components 2, 3, 4, 6 all have an outer boundary 99 with respect to the environment, for example outer surfaces in contact with the environment and/or interfaces such as the openings of an inlet port 21 and an outlet/exhaust port 25. Together, these boundaries define a full outer boundary for the expander 1, and thus define the full volume 9 of the expander.

Within the expander 1, there are additional components, arrangements and sections such as a piston arrangement 40 comprised by a piston 41 and piston rings 42, a connecting rod 43, a crankshaft 44 and a cylinder 45. The cylinder head 2 contains at least one inlet valve 22 and at least one exhaust valve 26, as well as the fluid separator 10. The inlet valve 22 may be of any type suitable for the application, such as a poppet, rotary, slide or disk valve, and is therefore not illustrated as a particular type on the figures. The exhaust valve 26 is shown on the figures as a poppet valve, however, the exhaust valve may also be of any suitable type.

Immediately above the piston 41, a working chamber 5 is defined. The lubricant reservoir (oil sump) 6 contains lubricant 61 and a lubricant heater 69, which serves to boil off working fluid that has been mixed into the lubricant.

First and second inner volumes 90*a*, 90*b* are defined as inner cavities in the cylinder head 2 and the crankcase 4 respectively. It should be noted that on FIGS. 1-3, a portion of the first inner volume 90*a* shown on the left hand side in the cylinder head 2 is in free communication with a portion of the first inner volume 90*a* shown on the right hand side. Further, a passage 90*c* provides free communication in the form of a free flow path 90*d* for fluids between the first and the second inner volumes 90*a*, 90*b*. Thus, the inner volumes 90*a*, 90*b* of the expander 1 can be seen as one united inner volume in terms of fluids occupying these spaces, as the fluids are free to flow between either one. The passage 90*c* is typically present due to the space required for a valve drivetrain (not shown) connecting the crankshaft 44 to a valve actuating system (also not shown).

Figure 2:
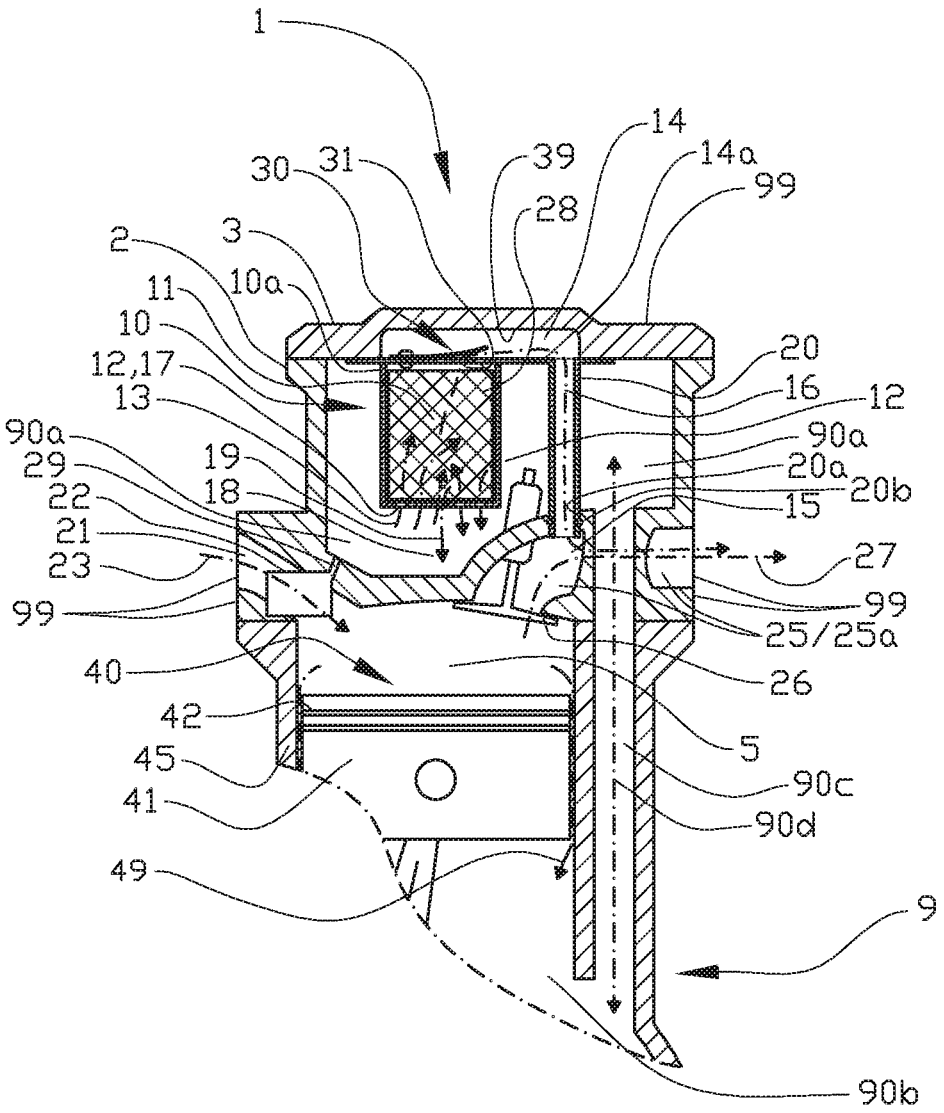
FIG. 2 shows the same displacement machine as in FIG. 1, wherein a coalescence promoting material is inserted into the fluid separator.
Figure 3:
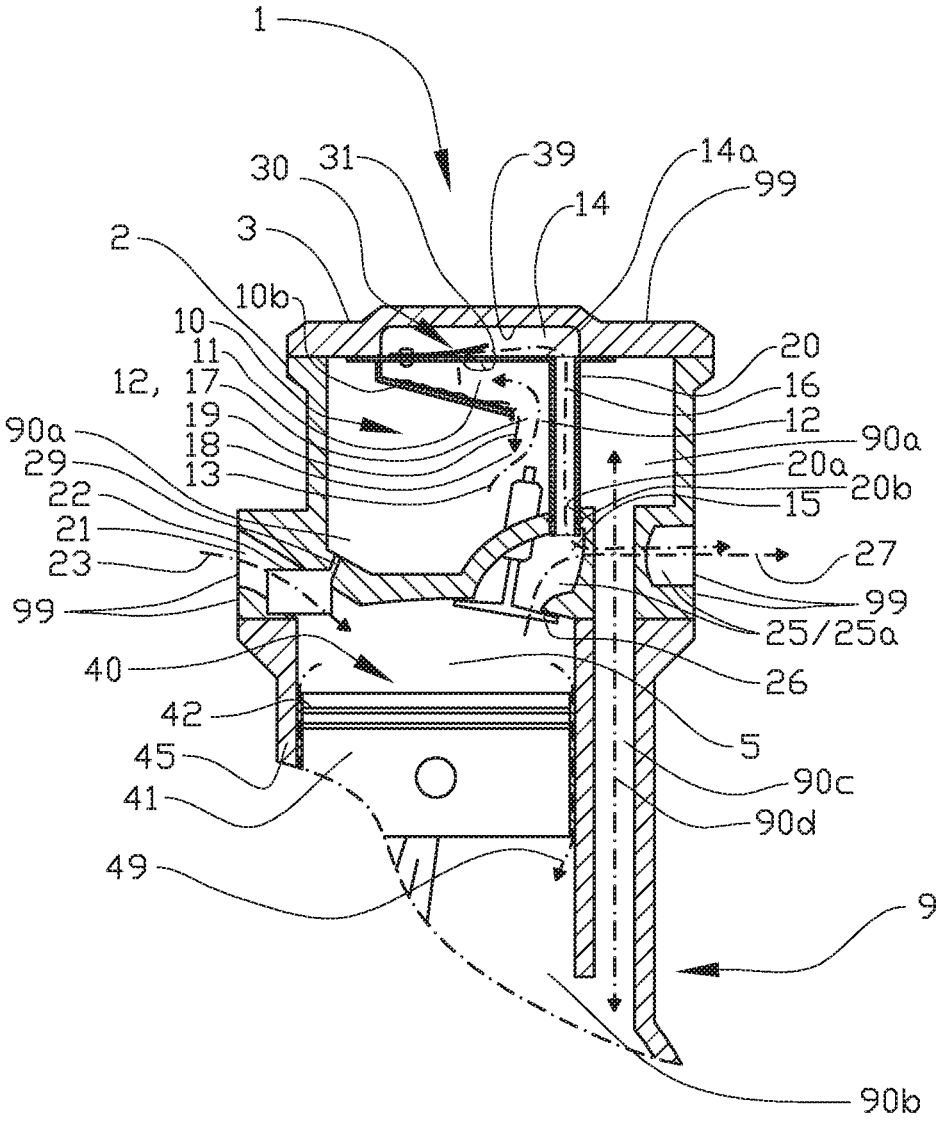
FIG. 3 shows the same displacement machine as in FIG. 1, wherein a simplified separator is installed.
Figure 4:
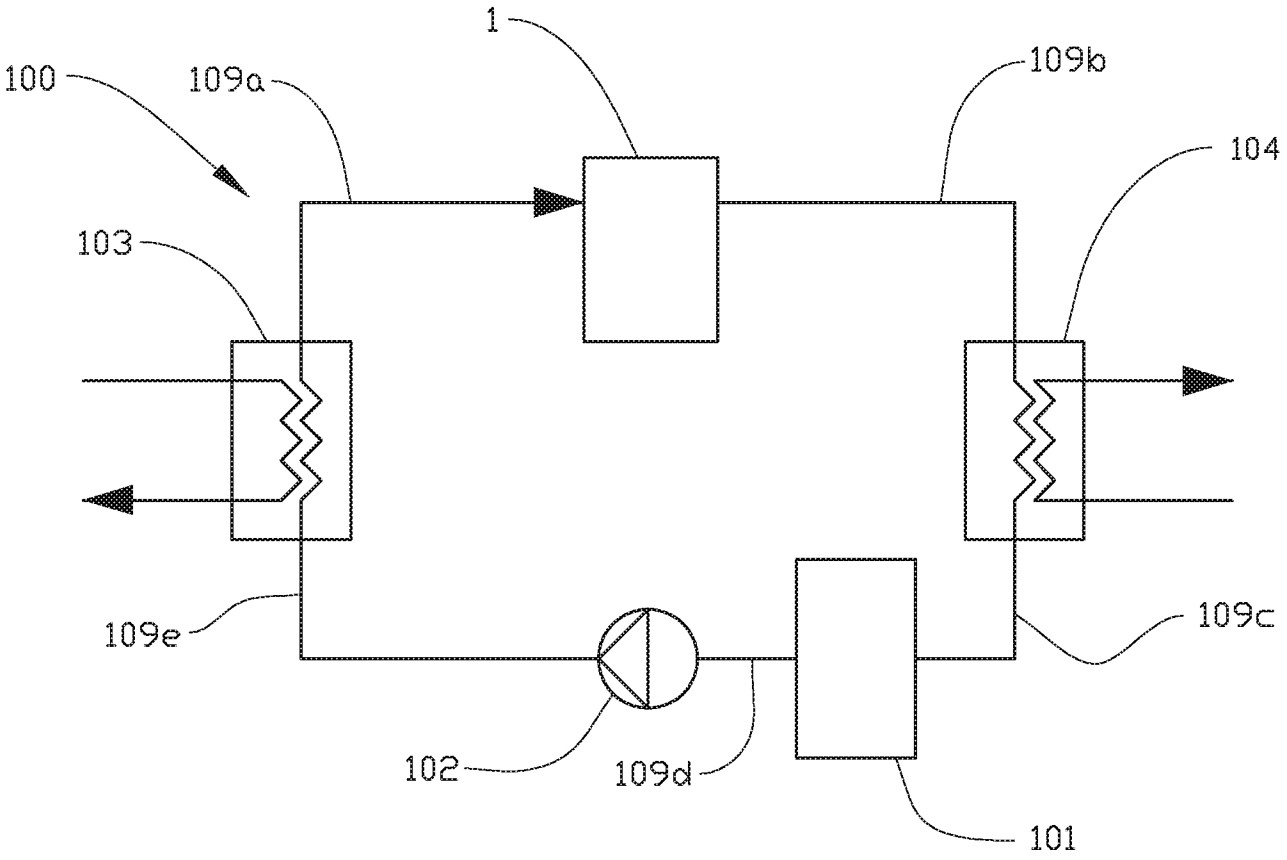
FIG. 4 shows a simplified flow schematic of an organic Rankine cycle, with its most essential components.

At the same time, it should be noted that the exhaust port 25, which in FIGS. 1-3 is indicated to be on either side of the passage 90*c*, is also free from obstruction between the left and right hand sides of the passage 90*c*, as the passage 90*c* doesn't directly interfere with the exhaust port 25 itself. On the figures, the passage 90*c* shall be perceived as being in front of the port 25.

In the following, FIGS. 1 and 5 are most relevant. Superheated vapour enters the expander 1 through the inlet port 21, wherein the inlet valve 22 controls the admission of working fluid into the working chamber 5. Together, the inlet port 21 and the inlet valve 22 provide a first, selectably open working fluid path 23 for the working fluid to enter the working chamber 5.

As the working fluid is admitted into the working chamber 5 at a higher pressure than the pressure of the inner volumes 90*a*, 90*b*, some working fluid may, and in most cases will, leak past a small gap formed between the piston arrangement 40 and the cylinder 45, as there is a small sealing gap between them. This sealing gap provides a leakage path 49 for the working fluid, which escapes from the working chamber 5 and past the piston 41. This leakage is often referred to as blow-by within some industries. The amount of working fluid that is subject to blow-by will then end up in the second inner volume 90*b* of the expander.

Due to that many valve types are not perfectly sealed, a small leakage path 29 may also be present in conjunction with the inlet valve 22, which may result in some working fluid typically also leaking into the first inner volume 90*a* of the expander 1. Likewise, a leakage path (not shown) may also be present in conjunction with the exhaust valve 26 and its corresponding valve actuation devices (not shown). A person skilled in the art would know how these devices are implemented, and they are therefore not shown on the figures.

At some point, the working fluid that is present in the inner volumes 90*a*, 90*b* of the expander 1 may start to mix into the lubricant 61. When this happens to a large extent, the viscosity of the lubricant/working fluid mixture may decrease (i.e. diluted lubricant), and if the viscosity becomes too low, this will impair the quality of the expander lubrication.

There are devices present, such as an oil pump (not shown) and lubricant distribution channels (not shown), to ensure proper lubrication of all regions in the expander 1 that need lubrication. An oil pump (not shown) draws lubricant/oil 61 from the oil sump 6 and distributes it to the respective regions. While some of the lubricant 61 is present in the oil sump 6, there will also be some lubricant 61 in other areas of the expander covering most inner surfaces in communication with the inner volumes 90*a*, 90*b*. Wherever there are lower temperatures, typically in lower sections (with respect to gravity) of the expander 1, chances are that the proportion of working fluid, which is mixed into the lubricant 61 is at the highest. This especially applies to the oil sump 6, and therefore a heater 69 may be added in order to boil off working fluid mixed with the oil 61 in here. This helps in maintaining a higher viscosity of the lubricant 61.

As more and more working fluid would accumulate in the inner volumes 90*a*, 90*b* due to the potential leakages described above, the pressure would rise, and thus more working fluid would be mixed with the oil. It would then come to a point at which the lubricant properties would cause an undesired, more rapid wear of the expander. One purpose of the fluid separator 10 is therefore to satisfactorily return working fluid to a section of the ORC system 100 wherein it primarily belongs, e.g. to the condenser 104 ultimately.

In the embodiment according to FIGS. 1 and 2, the fluid separator 10 comprises a shielding member in the form of a housing 10*a*, wherein a separator volume 11 is defined. A first fluid channel 12, which may be comprised by one or more physical channels (as shown on FIGS. 1 and 2) defines at least one fluid mixture inlet path 13, wherein a mixture of working fluid and lubricant primarily in the form of droplets, is admitted. A second fluid channel 14 formed in a cavity 39 in the valve cover 3 and defined by a fluid channel cover 14*a* connects the separator volume 11 to a working fluid return volume 15 via a return pipe 20 which is extending from the fluid channel cover 14*a* into a bore 20*a* in the cylinder head 2, the working fluid return volume 15 being part of the exhaust port 25. A seal 20*b* is provided between the return pipe 20 and the bore 20*a*. The second fluid channel 14 thus allows for working fluid to be returned to the condenser via the exhaust port, thus providing a working fluid return path 16 as shown on FIGS. 1, 2 and 3. If needed, a third fluid channel 17 may be provided, to make for a lubricant return path 19 into an appropriate lubricant return volume 18, which can typically be a more or less arbitrary but suitable section of the inner volumes 90*a*, 90*b*.

On FIG. 1, a large fraction of the lubricant 61 will, as it enters the separator volume 11, fall down due to gravity, and return to the first inner volume 90*a* through the third fluid channel 17. The working fluid, being generally in its gaseous phase, will continue and escape the separator volume 11 through a working fluid exit 31 prior to a valve arrangement 30, here provided as a reed valve arrangement. The valve arrangement 30 prevents pressure pulses in the exhaust system or the inner volumes 90*a*, 90*b* of the expander 1 to cause backflow of working fluid from the exhaust port 25. After the reed valve arrangement 30, and due to pressure differences, the working fluid is forced into the exhaust port 25, in which it joins and mixes with working fluid being exhausted from the working chamber 5.

Thanks to the invention, the fluids are separated and routed entirely within the full volume 9 of the expander. No external connections are needed between the separator 10 and devices placed externally from the expander 1. This eliminates several possible leakage points, as the need for external pipes, connections and fittings are eliminated altogether.

It should be noted that in a simple construction the first fluid channel 12, through which the fluid mixture enters the separator volume 11, may be mutually used as a lubricant return channel, since the lubricant is meant to be returned to the inner volumes 90*a*, 90*b* of the expander 1 anyway. This is shown on FIGS. 2 and 3. Here, there is no dedicated physical third channel, as the lubricant may return from the separator volume 11 in just the same way that it got in there. The return of lubricant from the inner volumes 90*a*, 90*b* to the oil sump 6 is provided through means of gravity and appropriate geometrical design of the expander's 1 interior. The specific implementation of this is not important to the invention, and is therefore not further described herein.

In still another embodiment (see FIG. 3), a shielding member in the form of a baffle 10*b* is constraining the separator volume 11, shielding the working fluid exit 31 and forming part of the lubrication return path 19.

Since several components in the expander 1 are under constant and vigorous movement, for example the piston 41, crankshaft 44, connecting rod 43 and valves 22, 26, there will be a continuous and intense movement (flow) of the fluids that are contained within the inner volumes 90*a*, 90*b*. This applies to the working fluid as well as to the lubricant, which will be partly in droplet or aerosol form. Because of this constant and intense fluid movement, the fluid separator 10 is shaped so as to limit the amount of lubricant being directly exposed to the working fluid exit 31. This is done by shielding the working fluid exit 31 and hence the working fluid return channel 14 from the inner volumes 90*a*, 90*b*. The shielding is for example provided by the oil separator housing 10*a* or the baffle 10*b* (as shown on FIG. 3).

In a specific embodiment of the invention, a coalescence promoting material 28 (as shown on FIG. 2) can be inserted into the separator volume 11 to further ensure that smaller lubricant droplets will coalesce and be returned appropriately (e.g. by gravity) to either of the inner volumes 90*a*, 90*b*.

Further, the invention assumes that the expander's 1 full volume 9 is completely sealed off from the environment through the implementation of appropriate sealing devices and methods. The inner volumes 90*a*, 90*b* of the expander 1 are generally free from air and other non-condensable gases, as the expander 1 has been evacuated prior to starting operation.

A compressor, for example acting as compressing means in a vapour compression based heat pump system, may use the exact same solution for fluid separation, only with the main difference that working fluid flow is effectively reversed relative to that of the ORC. In the vapour compression example, the working fluid return volume 15 would be part of a compressor suction port 25*a* rather than part of an expander exhaust port 25.

The expander 1 in the description may also be used reversibly as a compressor, providing that appropriate means for adjusting the valve timing are provided, and in that case it is possible to use the very same fluid separator 10 as is, since the exhaust valve 26 can then act as an inlet (suction) valve instead, and therefore the working fluid return volume 15 would be part of the suction port as noted above.

During cold start-up of the displacement machine 1, there may be more working fluid mixed with the lubricant 61 in the sump 6 than during normal operating conditions. There is therefore a method in place to limit the negative effects of excess oil dilution at start-up. The method involves in a first step to add heat to the lubricant 61 in the sump 6 by means of a heater 69 (see FIG. 1). Further, the method has a second step, which comprises to measure and detect a minimum temperature of the lubricant 61, and then to provide a ready signal to a control system, which then allows the displacement machine to be started.

Lastly, other displacement devices acting the same way or at least having a similar application may also benefit from the invention. For example, a Wankel expander or Wankel compressor could in many cases benefit from the fluid separator solution described herein.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A displacement machine arranged for acting on and expanding a working fluid in an organic Rankine cycle system, and being provided with a lubricant and working fluid separator, the displacement machine further comprising a displacer housing, a displacer arrangement displaceable within the displacer housing, a working chamber upon which the displacer arrangement acts to change its volume, at least one inner volume arranged for containing a lubricant and a working fluid, working fluid ports providing fluid communication between at least one volume external to the displacement machine and the working chamber, and a leakage path formed between the displacer arrangement and the displacer housing, wherein the fluid separator comprises a separator volume constrained by a shielding member, a first fluid channel providing fluid communication between the at least one inner volume and the separator volume, a second fluid channel providing fluid communication between the separator volume and a working fluid return volume, and wherein the fluid separator, the first fluid channel and the second fluid channel are fully contained within a volume defined by an outer boundary and completely sealed off from the environment wherein the displacement machine is geometrically fully constrained.

2. The displacement machine according to claim 1, wherein the at least one inner volume comprises a first inner volume and a second inner volume, and wherein the first inner volume is freely communicating with the second inner volume.

3. The displacement machine according to claim 1, wherein the shielding member is a baffle shielding a working fluid exit in the fluid separator.

4. The displacement machine according to claim 1, wherein the shielding member is a housing shielding a working fluid exit in the fluid separator.

5. The displacement machine according to claim 1, wherein the separator volume is defined in a housing containing a coalescence promoting material.

6. The displacement machine according to claim 1, wherein a working fluid exit in the fluid separator is provided with a valve arrangement arranged to prevent backflow or backpressure from the exhaust port propagating into the separator volume.

7. The displacement machine according to claim 6, wherein the fluid separator valve arrangement is a reed valve arrangement.

8. The displacement machine according to claim 1, wherein a fluid mixture inlet path into the separator volume and a lubricant return path into an appropriate lubricant return volume are provided in the first fluid channel.

9. The displacement machine according to claim 1, wherein the second fluid channel is extending in a sealed manner into the working fluid return volume through a bore in a cylinder head.

10. The displacement machine according to claim 1, wherein the second fluid channel is arranged in a cylinder head cover and is defined by a cover and a return pipe extending in a sealed manner from the cover into the working fluid return volume through a bore in a cylinder head.

11. The displacement machine according to claim 1, wherein the working fluid return volume is inside an exhaust port of an expander or a suction port of a compressor.

12. A displacement machine arranged for acting on and compressing a working fluid in a vapor compression heat pump system, and being provided with a lubricant and working fluid separator, the displacement machine further comprising a displacer housing, a displacer arrangement displaceable within the displacer housing, a working chamber upon which the displacer arrangement acts to change its volume, at least one inner volume arranged for containing a lubricant and a working fluid, working fluid ports providing fluid communication between at least one volume external to the displacement machine and the working chamber, and a leakage path formed between the displacer arrangement and the displacer housing, wherein the fluid separator comprises a separator volume constrained by a shielding member, a first fluid channel providing fluid communication between the at least one inner volume and the separator volume, a second fluid channel providing fluid communication between the separator volume and a working fluid return volume, and wherein the fluid separator, the first fluid channel and the second fluid channel are fully contained within a volume defined by an outer boundary and completely sealed off from the environment wherein the displacement machine is geometrically fully constrained.

13. The displacement machine of claim 1, wherein the at least one inner volume is evacuated of air.

* * * * *